United States Patent [19]

Hofmann

[11] 4,016,480

[45] Apr. 5, 1977

[54] DUAL FUNCTION COUPLING SYSTEM AND METHOD

[75] Inventor: Judson A. Hofmann, Schaumburg, Ill.

[73] Assignee: Zenith Radio Corporation, Chicago, Ill.

[22] Filed: Mar. 4, 1974

[21] Appl. No.: 448,136

[52] U.S. Cl. ..... 323/8; 323/19; 340/253 R; 340/253 Z; 340/310 R; 340/310 A

[51] Int. Cl.[2] ..... G08C 19/02; G05F 3/08

[58] Field of Search ..... 323/1, 4, 8, 16, 19, 323/22 T, 68; 340/172, 186, 210, 253 R, 253 Z, 310 R, 310 A

[56] References Cited

UNITED STATES PATENTS

| | | | |
|---|---|---|---|
| 3,388,318 | 6/1968 | O'Brien | 323/22 T |
| 3,460,121 | 8/1969 | Wattenburg | 340/310 A |
| 3,503,261 | 3/1970 | Riester et al. | 340/186 X |
| 3,560,948 | 2/1971 | Inose et al. | 340/210 X |
| 3,597,676 | 8/1971 | Moore | 323/68 X |
| 3,684,924 | 8/1972 | Miller | 340/210 UX |
| 3,757,195 | 9/1973 | Sklaroof | 340/210 X |
| 3,797,008 | 3/1974 | Yuasa | 340/253 R |

OTHER PUBLICATIONS

Barr, Remotely Powered Measurement Systems, IBM Technical Disclosure Bulletin, vol. 13, No. 8, Jan. 1971, pp. 2255, 2256.

*Primary Examiner*—A. D. Pellinen
*Attorney, Agent, or Firm*—Roy A. Ekstrand

[57] ABSTRACT

An additional signal is supplied to an integrated circuit, including a voltage regulator and a plurality of electronic circuit elements, by impressing the signal on a terminal coupled to the voltage regulator. Circuitry in the integrated circuit recover the signal by detecting the voltage regulator response thereto. Method and apparatus with voltage regulators of shunt and series type are described.

14 Claims, 5 Drawing Figures

DUAL FUNCTION COUPLING SYSTEM AND METHOD

BACKGROUND OF THE INVENTION

Integrated circuits (IC's) comprise a number of semiconductor devices formed on a single substrate or monolithic chip and are finding increased use in electronic circuit applications, because of their small size, low cost and high reliability. They are especially useful for small signal processing circuits. Large numbers of transistors, resistors and diodes, as well as small capacitors, can easily and economically be constructed upon a small "chip" which is typically 2,000 to 10,000 square mils in area. The chip circuitry requires terminal connections for signal coupling and operating potentials. Additionally, inductive circuit elements, large capacitors and other external components are connected to the chip via terminals. Complex integrated circuits generally include a voltage regulator to provide a substantially constant internal source of DC potential for portions of the IC circuitry.

Monolithic technology is a complex subject. However, a brief summary of integrated circuit construction may be helpful. Electronic circuit devices are formed on the wafer, or chip, of semiconductor material, generally silicon, by depositing or implanting regions of N or P semiconductor material in predetermined patterns. N material may be thought of as a source of electrons and P material as a source of positive charges called holes. For example, a diode comprises adjacent deposits of P and N materials. Similarly, a PNP transistor is formed by a sandwich of two regions of P material separated by a region of N material, with the N material defining the base and the P regions the emitter and collector. Selected portions of the circuitry within the chip are connected by conductive paths to bonding pads located near the chip periphery.

The monolithic chip is packaged, or encapsulated, within an insulating container and connections are made, generally by bonding gold filament-like leads, between each of the bonding pads and a corresponding terminal. Once encapsulated, the IC package is an insulated, sealed capsule having a limited number of exposed terminals for making connections between external devices and those within the chip.

The commonly used integrated circuit packages in consumer electronics are of the dual-in-line configuration in which a flat elongated molded capsule houses a monolithic chip and supports two parallel rows of terminals along each side, giving the package a caterpillar-like appearance. Such packages generally have from 12 to 24 terminals. Configurations with more than 24 terminals have disadvantages, such as difficulty of insertion into a mating socket without terminal damage and a much higher probability of defective terminal bonding connections.

IC economics is also largely predicated on high volume production and consequently there is great emphasis placed on standard packaging. Often, desirable circuit changes are not implemented for lack of a terminal. Similarly, a large number of devices may be in use and servicing considerations dictate that succeeding devices be compatible and interchangeable. There may, of course, be any number of situations where an "extra pin" is desired on an IC, or where it is desirable to couple an additional signal to the IC.

In accordance with the invention, a terminal coupled to a voltage regulator in an IC may also be used to couple an external signal to the IC.

OBJECTS OF THE INVENTION

Accordingly, it is an object of the present invention to provide a novel and more economical integrated circuit and method of operation.

It is a further object of the present invention to provide a novel signal coupling system and method for an IC.

SUMMARY OF THE INVENTION

A method of supplying an additional signal to an integrated circuit having a plurality of electronic circuit elements and voltage regulating means, and a limited number of externally accessible terminals comprises applying the signal to the terminal coupled to the voltage regulating means and recovering the signal by detecting the voltage regulating means response to the signal.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings in which like reference numerals identify like elements and in which:

DESCRIPTION OF THE PREFERRED EMBODIMENTS

Figure 1:
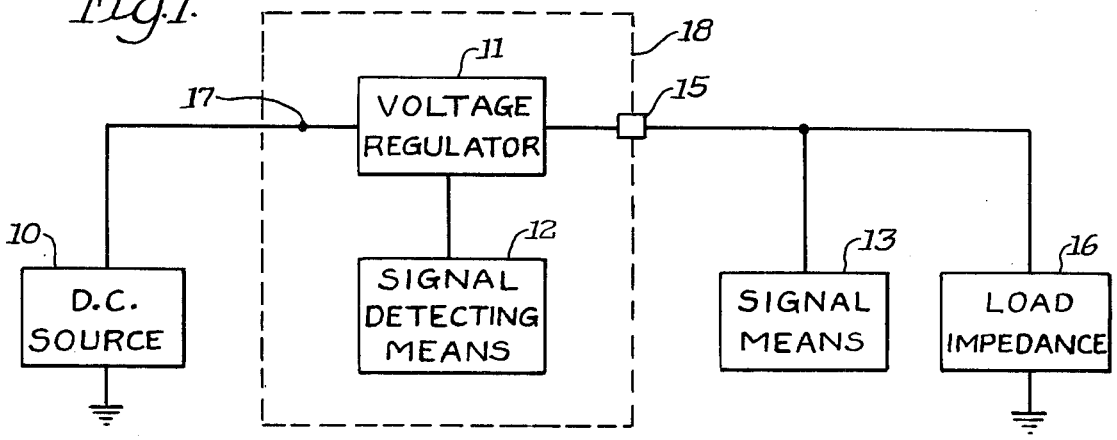
FIG. 1 is a block diagram representative of a signal coupling system constructed in accordance with one aspect of the present invention.
Figure 2:
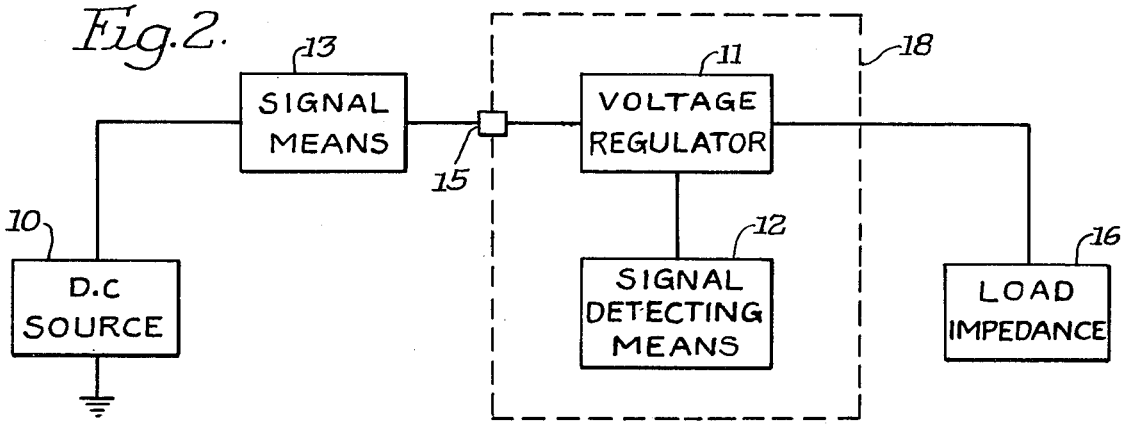
FIG. 2 is a block diagram representative of a signal coupling system constructed in accordance with another aspect of the present invention.
Figure 3:
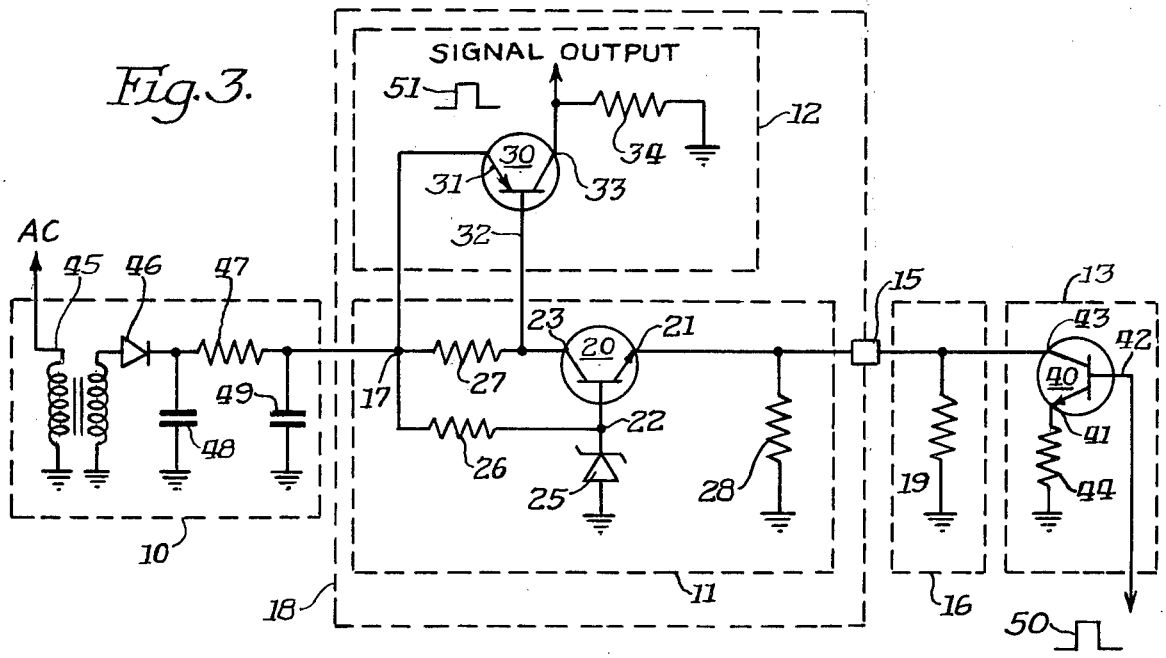
FIG. 3 is a schematic diagram disclosing an embodiment of the signal coupling system shown in block diagram form in FIG. 1.

Voltage regulators are generally described as being either series, shunt or combination series-shunt. Series regulators are characterized by a variable element (passing element) which couples the unregulated DC source to the load and as a result conducts the full load current. Shunt regulators are characterized by a variable element coupled in parallel with the load for diverting current around the load. Obviously series-shunt combination regulators are those which include at least one of each element type. The present invention applies to any type voltage regulator. The term voltage regulator is used in the discussions which follow as being most descriptive of the intended circuit function. It should, however, be kept in mind that its use is intended in the more broad sense of voltage regulation means and, therefore, embraces other similarly functioning circuitry (e.g., low impedance DC sources and DC coupled buffer amplifiers). FIGS. 1 through 3 disclose series regulator applications while FIGS. 4 and 5 disclose shunt regulator applications.

FIG. 1 shows a block diagram representation of a circuit embodying one aspect of the present invention. A dashed line 18 represents an integrated circuit. A DC potential is supplied by a source 10 to the input 17 of a voltage regulator 11, the output of which is coupled, via a selected terminal 15 of integrated circuit 18, to a load impedance 16 and to a signal means 13 which may include a source of signal voltage (not specifically shown). A signal detecting means 12 is coupled to voltage regulator 11, both of which are located within the integrated circuit. It will be appreciated that only the essential elements of the circuit are disclosed, for simplicity. Integrated circuit 18 will be understood to include a large number of electronic components for performing various circuit functions. Similarly, integrated circuit 18 includes a plurality of terminals for connecting the internal electronic components to external elements, only one of which (terminal 15) is illustrated. DC voltage source 10 may be either external to the integrated circuit, as shown in FIG. 1, or internal.

In the absence of signal from signal means 13, energy supplied by DC source 10 is coupled to load impedance 16 by voltage regulator 11 at a substantially constant voltage notwithstanding variations in applied DC at terminal 17 nor changes in the current required by load 16. In a typical application, load 16 may comprise active circuitry which would, during circuit operation, change in effective impedance and thereby present varying current requirements. Similarly, DC potential source 10 may be subject to variations of its output voltage due, for example, to power line variations, if an AC derived source, or due to aging, etc., if a battery source.

Changes in the voltage applied and current required define normal operating conditions and it is the primary function of the voltage regulator to compensate for such changes as will be discussed later in greater detail. However, suffice it to say at this point that in response to changes in these operating conditions, compensating elements within the regulator alter its voltages and currents to maintain a constant load voltage. Variations anticipated during such normal operating conditions define the normal regulation range of the regulator while the maximum range of operating conditions which can be compensated by the regulator (while still maintaining a substantially constant load voltage) defines its maximum regulation range.

Any signal applied by signal means 13 to terminal 15 changes the circuit operating conditions. The voltage regulator responds to, that is, compensates for, these changes to maintain the desired load voltage. Signal detecting means 12 is arranged to detect the response of the compensating elements within voltage regulator 11. A threshold detector (not shown) within signal detecting means 12 responds solely to compensating elements changes which are in excess of those resulting from normal operating condition changes. The signal amplitude from signal means 13 is sufficient to produce regulator compensating means responses in excess of those due to normal operating conditions changes, but within the maximum regulating capability of the regulator. Hence, terminal 15 has been put to a "double use," in that it couples the regulator and load and also carries an external signal into the IC. The applied signal may be a simple DC or "state" voltage or a more complex signal forming a trigger pulse. It may, in some applications, be required to couple a modulated information bearing signal. In such case, the information bearing signal is imposed on a pedestal signal which causes compensating elements responses beyond normal to permit recovery.

FIG. 2 shows a block diagram representation of another aspect of the present invention which is similar to that shown in FIG. 1, the difference being that signal means 13 is not coupled to load 16 but is interposed between DC source 10 and voltage regulator 11. Voltage regulator 11 and signal detecting means 12 are located within integrated circuit 18 and load impedance 16 may be either external to the integrated circuit (as shown) or internal. As described, the voltage regulator maintains a substantially constant voltage across load impedance 16. Signal means 13, however, changes the input voltage to regulator 11 which responds to and compensates for the changes. Those changes of the compensating elements which exceed the normal operating conditions range similarly activate a threshold detector in, and are recovered by, signal detecting means 12. Again terminal 15 has been employed to couple an external signal to the IC in addition to its normal function.

A schematic representation of a circuit constructed in accordance with the present invention is shown in FIG. 3 in which the block diagram representations used in FIG. 1 are indicated by dashed lines. DC source 10 comprises a power source which by the familiar line rectification process converts an applied alternating voltage to a DC operating voltage. A power transformer 45 has a primary winding coupled to a source of AC voltage and a secondary winding coupled to the anode of a diode 46. The rectified output at the cathode of diode 46 is applied to a pi filter composed of an input capacitor 48, a series resistor 47 and an output capacitor 49. The rectified and filtered DC operating voltage is coupled to an input 17 of voltage regulator 11. This DC voltage is unregulated, that is, subject to variations whenever the magnitude of applied AC voltage load current required changes.

Voltage regulator 11 includes a variable conduction element comprising a series pass NPN type silicon transistor 20 having a base 22 coupled to ground through a reference Zener diode 25, an emitter 21 coupled to ground through a resistor 28 and a collector 23 coupled to input 17 by a resistor 27. Resistor 26 couples input 17 and base 22. The potential across Zener diode 26 due to current flowing in resistor 26 causes Zener diode 25 to conduct and establish a fixed reference potential at base 22 which, in turn, causes transistor 20 to conduct and establish a voltage at emitter 21 which is approximately 0.6 volt below the voltage at base 22. The conduction of transistor 20 couples the DC voltage at input 17 to load 16, represented by a resistor 19, via a path which includes series resistor 27, the collector to emitter circuit of transistor 20 and selected IC terminal 15. In a transistor, collector current flows to the extent necessary to establish the relative base to emitter voltage required. For an NPN silicon transistor, this is approximately +0.6 volt. The transistor base is held at a constant potential by Zener diode 25 and, therefore, its emitter is also at a substantially constant potential. Resistor 27, transistor 20 and the combination of impedances coupling emitter 21 to ground perform a division of the DC voltage at input 17. The collector to emitter voltage of transistor 20 adjusts, in response to changes in either the voltage applied at input 17 or the impedance coupling emitter 21 to ground, to maintain a constant voltage at emitter 21.

Because a constant load voltage requires a constant current in the absence of load change, any variation in voltage at input 17, such as would result from AC line changes, must be compensated by a change in the collector to emitter voltage of transistor 20. Similarly, changes in the impedance of load 16 result in changes in current flow in transistor 20 altering its collector to emitter voltage and maintaining a constant voltage at emitter 21.

Signal means 13 comprises a transistor 40 having a collector 43 coupled to grounded load resistor 19 and selected terminal 15, a base 42 coupled to a source of signal and an emitter 41 coupled to ground through a resistor 44. A positive going signal, indicated by waveform 50, at base 42 causes normally off transistor 40 to conduct coupling resistor 44 to resistor 19 via its collector-emitter path and reducing the effective impedance coupling emitter 21 to ground. In response to this reduction in effective impedance, the collector-emitter current in transistor 20 increases causing an increase in voltage across resistor 27. As a result of the combined actions of transistor 40 and resistor 27, the responses of compensating transistor 20 to both variations of operating conditions and applied signal appear within voltage regulator 11 as changes in voltage across resistor 27. For complete signal coupling, the responses due to applied signal are selected from those caused by normal changes in operating conditions.

Signal detecting means 12 comprises a PNP transistor 30 having a base 32 coupled to collector 23 of transistor 20, an emitter 31 coupled to input 17, and a collector 33 coupled to ground through a resistor 34. The base to emitter voltage of transistor 30 is controlled by the flow of current through resistor 27 and, under normal operating conditions (e.g., no signal from signal means 13), the voltage developed is not sufficient to cause conduction in transistor 30. With the application of a signal to transistor 40 and the resulting increased conduction in transistor 20, the voltage developed across resistor 27 exceeds the threshold required to turn on transistor 30 and current flows from input 17, through the emitter to collector circuit of transistor 30, and resistor 34 to ground. The emitter-base junction of transistor 30 provides threshold means by responding only to collector currents of transistor 20 which develop the required voltage. The current flowing in transistor 30 develops a voltage across resistor 34, indicated by waveform 51, and that portion of the applied signal which produces changes in compensating transistor 20, in excess of those resulting from normal variations in operating conditions, is recovered at collector 33.

Figure 4:
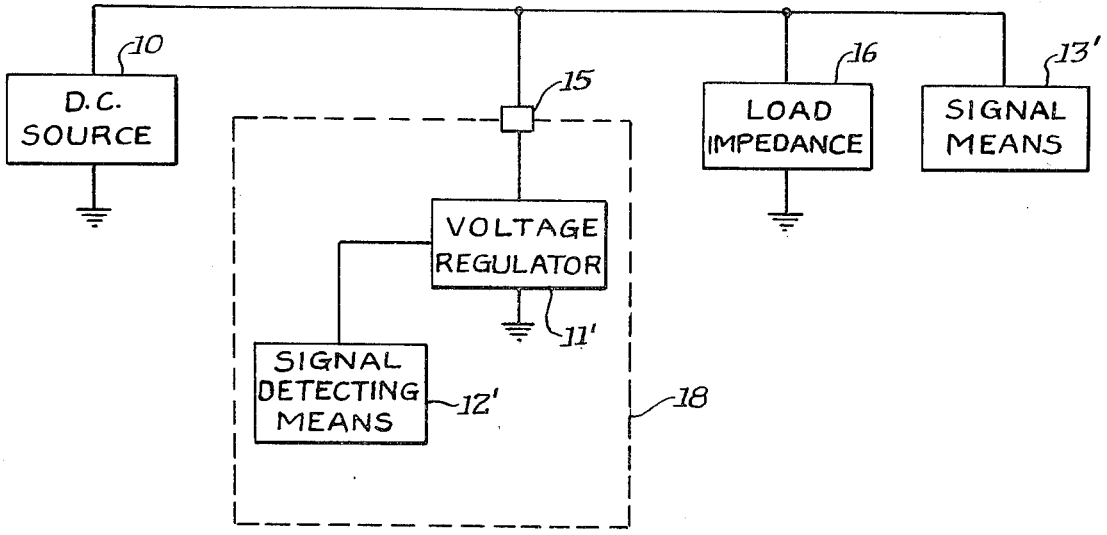
FIG. 4 is a block diagram representative of a signal coupling system constructed in accordance with the present invention using a shunt regulator.

FIG. 4 shows a block diagram representation of a circuit constructed in accordance with the present invention using a shunt type voltage regulator. A DC source 10 is coupled to a load impedance 16 and a signal means 13'. A voltage regulator 11' within integrated circuit 18 is coupled via selected integrated circuit terminal 15 to load impedance 16. A signal detecting means 12' also within the integrated circuit is coupled to threshold means (not shown) within voltage regulator 11'.

In operation DC source 10 provides electrical energy to both load impedance 16 and voltage regulator 11' which, in turn, diverts an appropriate amount of current from load 16 to maintain a constant load voltage. For example, an increase in the output of source 10 above the desired voltage would, without regulator 11', cause a corresponding increase in the voltage across load 16. However, the voltage regulator diverts a corresponding increased current thereby maintaining a constant load voltage. Similarly, a decrease in the effective impedance of load 16 causes a reduction in the voltage across the load. Again, however, the conduction of voltage regulator 11' changes (in this case, decreasing) and increases current flow in load 16 to maintain the desired load voltage.

Signal means 13' applies a signal to terminal 15 causing a change in the effective load impedance coupled to source 10. Voltage regulator 11' responds by diverting sufficient current to maintain the load voltage. The applied signal is recovered by detecting means 12' detecting the response of voltage regulator 11' to the change in effective load impedance. Signal means 13' applies a signal of sufficient amplitude to produce voltage regulator responses beyond those caused by normal operating conditions. The nature of the applied signal may be a state voltage, pulse or information bearing signal imposed on a pedestal voltage.

Figure 5:
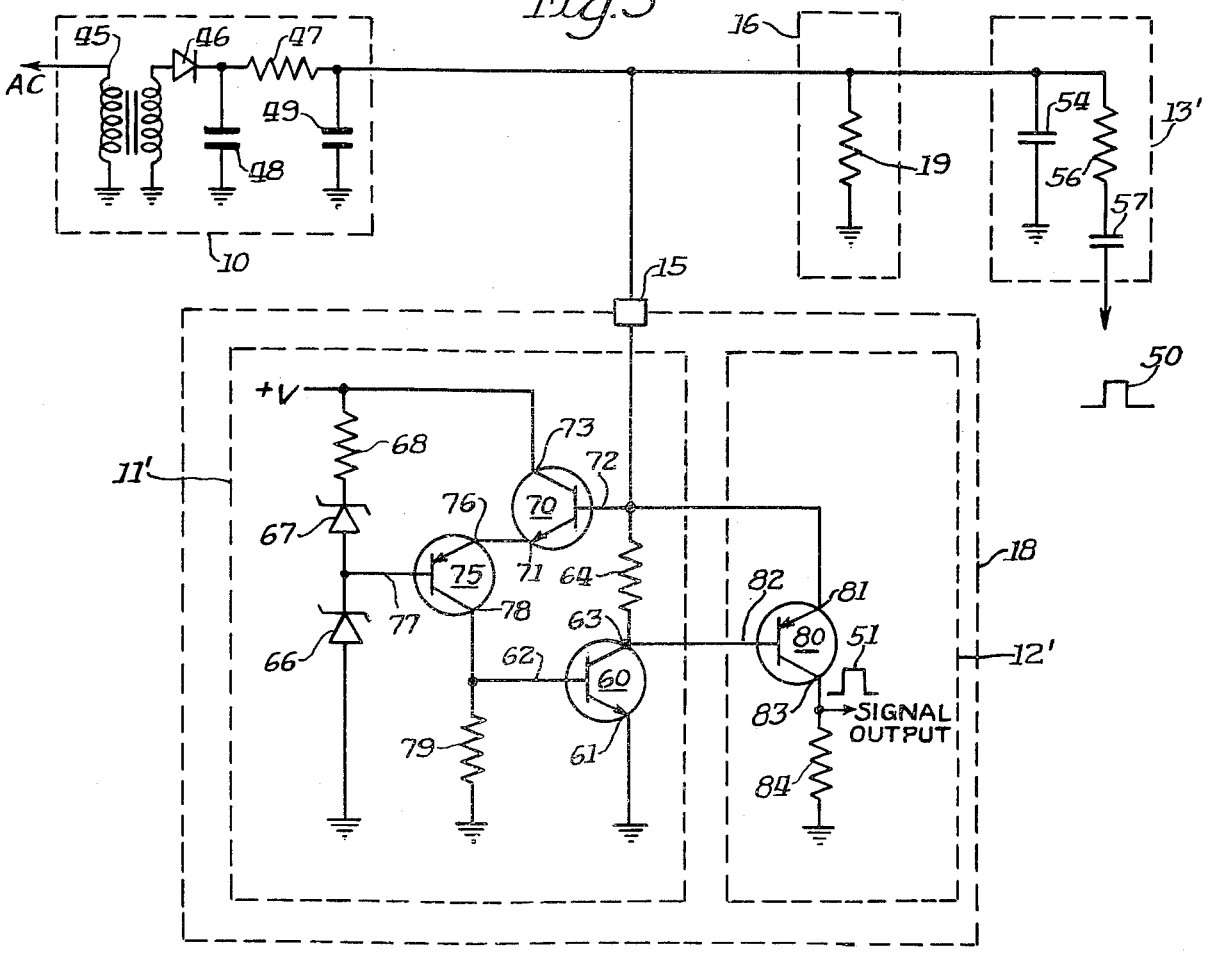
FIG. 5 is a schematic disclosing an embodiment of the signal coupling system shown in block diagram form in FIG. 4.

FIG. 5 is a schematic representation of a circuit of the type shown in block diagram form in FIG. 4. The AC line rectifying DC source 10 of FIG. 3 is repeated in FIG. 5 and includes power transformer 45 coupling an AC voltage to rectifier 46 which, in turn, is coupled to a pi filter composed of series resistor 47 and capacitors 48 and 49. The output of source 10 is applied to load 16, here schematically indicated as a resistor 19, but which may also include active circuitry. Voltage regulator 11' is coupled to the junction of source 10 and load 16 via terminal 15. The voltage at terminal 15 is applied to a base 72 of a transistor 70 which has a collector 73 coupled to a positive potential +V. A transistor 75 has an emitter 76 coupled to emitter 71 of transistor 70, a base 77 coupled to ground through a Zener diode 66 and to +V through a series combination of a Zener diode 67 and a resistor 68. Collector 78 is coupled to a base 62 of a transistor 60 and to ground through a resistor 79. Transistor 60 has a grounded emitter 61 and a collector 63 coupled to terminal 15 by a resistor 64 forming a variable conduction element.

The voltage at terminal 15 (also the voltage at load 16) is applied through the emitter-base junction of transistor 70 to emitter 76 of transistor 75 which has a substantially constant reference potential at its base 77 established by Zener diode 66. The conduction of transistor 75 thus varies in accordance with changes in its emitter potential and produces corresponding voltages across its collector load resistor 79. This voltage is applied to base 62 of transistor 60 and determines that transistor's level of conduction. A voltage increase at terminal 15 increases conduction in transistors 70 and 75 which increases the voltage across resistor 79 (the base voltage of transistor 60). Transistor 60 conducts more heavily and diverts more current from load 16. Similarly, a reduction in voltage at terminal 15 causes reduced conduction in transistors 70, 75 and 60, thus diverting less current from load 16.

Signal means 13' couples a positive going signal voltage (indicated by waveform 50) via capacitors 54 and 57 and resistor 56 to load 16 and, in the manner described above, conduction in transistor 60 is increased such that the voltage at load 16 remains substantially constant. This increased conduction also results in an increased voltage across resistor 64. Detecting means 12′ comprises a transistor 80 having an emitter 81 coupled to terminal 15, a base 82 coupled to collector 63 of transistor 60 and a collector 83 coupled to ground via a resistor 84. The emitter-base voltage of transistor 80 is established by the collector current of transistor 60 flowing through resistor 64. Under normal conditions transistor 80 is non-conducting because the voltage across resistor 64 is insufficient to turn it on. With the increased conduction of transistor 60 in response to applied signal 50, the voltage developed exceeds the required emitter-base threshold and causes transistor 80 to conduct producing a flow of collector current to ground through resistor 84 and developing the recovered signal voltage 51. Thus, the emitter-base junction of transistor 80 provides threshold means for recovering that portion of the applied signal which produces compensating responses by transistor 60 outside those resulting from normal operating conditions.

What has been described is a method and apparatus for coupling an additional signal to an integrated circuit having a voltage regulator. While particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

What is claimed is:

1. A signal coupling system comprising:

an integrated circuit having a plurality of electronic circuit elements and a plurality of externally accessible terminals connected to said circuit elements;

voltage regulating means in said integrated circuit coupled to a selected one of said plurality of terminals;

signal means, external to said integrated circuit applying a signal to the selected terminal; and signal detecting means, within said integrated circuit, recovering said signal by detecting the response of said voltage regulating means to said signal.

2. A signal coupling system as in claim 1, further including:

a source of DC potential and a load impedance coupled thereto, said voltage regulating means maintaining a substantially constant voltage across said load impedance, and wherein said signal detecting means includes:

threshold means sensing those voltage regulating means responses outside a predetermined range;

said signal means producing responses in said voltage regulating means which are outside said predetermined range.

3. A signal coupling system as in claim 2, wherein said threshold means comprises a semiconductor junction.

4. A signal coupling system as in claim 2, said voltage regulating means including a variable conduction element coupled to said load impedance via said terminal for diverting current from said load impedance and maintaining said substantially constant load voltage.

5. A signal coupling system as in claim 4, wherein said variable conduction element comprises:

a transistor having its collector to emitter current path connected in parallel with said load.

6. A signal coupling system as in claim 2, wherein said voltage regulating means is interposed between said DC source and said load impedance, said voltage regulating means including a series regulating element maintaining said constant load voltage.

7. A signal coupling system as in claim 6, wherein said voltage regulating means is coupled to said load impedance via said selected terminal; said signal means altering the effective load coupled to said voltage regulating means.

8. A signal coupling system as in claim 7, wherein said signal means includes:

a source of signal; and a transistor having its base electrode coupled to said source of signal and its emitter-collector path coupling said terminal to ground.

9. A signal coupling system as in claim 6, wherein said voltage regulating means is coupled to said source of DC potential via said terminal, said signal means altering the DC potential applied to said voltage regulating means.

10. A signal coupling system as in claim 9, wherein said signal means includes:

a transistor having its base electrode coupled to said source of signal and its emitter-collector path coupling said terminal to ground.

11. In a signal processing system including an integrated circuit having a plurality of electronic circuit elements and a limited number of externally accessible terminals, said integrated circuit including voltage regulating means coupled to one of said terminals for maintaining a substantially constant voltage across a load impedance, the method of feeding an additional signal into said integrated circuit comprising:

applying said signal to said one terminal and causing said voltage regulating means to make a compensating response to maintain said substantially constant load voltage; and detecting the response of said voltage regulating means to said applied signal.

12. The method of claim 11, wherein said signal processing system includes a source of DC potential and said voltage regulating means includes a series regulating element interposed between said DC source and said load impedance, further including the steps of:

varying the impedance coupled to said one terminal in response to the applied signal and causing said series regulating element to change conduction beyond a predetermined range; and detecting those changes outside of said predetermined range.

13. The method of claim 11, wherein said signal processing system includes a source of DC potential and said voltage regulating means includes a series regulating element interposed between said DC source and said load impedance, further including the steps of:

varying said DC potential in response to the applied signal and causing the voltage across said series regulating element to change beyond a predetermined range; and detecting those changes outside of said predetermined range.

14. The method of claim 11, wherein said signal processing system includes a source of DC potential coupled to said load impedance and said voltage regulating means includes a variable conduction element coupled to said load impedance for changing current flow around said load impedance to maintain a substantially constant load voltage, further including the steps of:

varying the impedance coupled to said terminal in response to said signal causing conductive changes in said variable conduction element beyond a predetermined range; and detecting those changes outside said predetermined range.

* * * * *